US007507267B2

(12) United States Patent
Hall et al.

(10) Patent No.: US 7,507,267 B2
(45) Date of Patent: Mar. 24, 2009

(54) ABRASIVE TOOLS MADE WITH A SELF-AVOIDING ABRASIVE GRAIN ARRAY

(75) Inventors: Richard W. J. Hall, Southborough, MA (US); Jens M. Molter, Hamburg (DE); Charles A. Bateman, Rutland, MA (US)

(73) Assignee: Saint-Gobain Abrasives Technology Company, Worcester, MA (US)

( * ) Notice: Subject to any disclaimer, the term of this patent is extended or adjusted under 35 U.S.C. 154(b) by 384 days.

(21) Appl. No.: 11/229,408

(22) Filed: Sep. 16, 2005

(65) Prior Publication Data

US 2006/0010780 A1 Jan. 19, 2006

Related U.S. Application Data

(63) Continuation of application No. 10/683,486, filed on Oct. 10, 2003, now abandoned.

(51) Int. Cl.

| | |
|---|---|
| ***B24D 3/00*** | (2006.01) |
| ***B24D 11/00*** | (2006.01) |
| ***B24D 3/02*** | (2006.01) |
| ***C09K 3/14*** | (2006.01) |

(52) U.S. Cl. ..... 51/293; 51/308; 51/309

(58) Field of Classification Search ..... 51/293, 51/308, 309

See application file for complete search history.

(56) References Cited

U.S. PATENT DOCUMENTS

| | | | | |
|---|---|---|---|---|
| RE26,879 | E | 5/1970 | Kelso | 51/295 |
| 4,925,457 | A | 5/1990 | deKok et al. | |
| 4,931,069 | A | 6/1990 | Wiand | |
| 5,014,468 | A | 5/1991 | Ravipati et al. | |
| 5,049,165 | A | 9/1991 | Tselesin | |
| 5,152,917 | A | 10/1992 | Pieper et al. | |
| 5,304,223 | A | 4/1994 | Pieper et al. | |
| 5,492,771 | A | 2/1996 | Lowder et al. | 428/565 |
| 5,669,943 | A | 9/1997 | Horton et al. | |
| 5,833,724 | A | 11/1998 | Wei et al. | |
| 5,842,912 | A | 12/1998 | Holzapfel et al. | 451/72 |
| 5,863,306 | A | 1/1999 | Wei et al. | |
| 5,980,678 | A | 11/1999 | Tselesin | |

(Continued)

FOREIGN PATENT DOCUMENTS

| | | |
|---|---|---|
| DE | 69210221 T2 | 1/1997 |

(Continued)

OTHER PUBLICATIONS

Examination Report issued in German Application No. 11 2004 001 912.5.

(Continued)

*Primary Examiner*—Jerry Lorengo
*Assistant Examiner*—Shuangyi Abu Ali
(74) *Attorney, Agent, or Firm*—Mike W. Crosby

(57) ABSTRACT

Abrasive tools contain abrasive grains oriented in an array according to a non-uniform pattern having an exclusionary zone around each abrasive grain, and the exclusionary zone has a minimum dimension that exceeds the maximum diameter of the desired grit size range for the abrasive grain. Methods for designing such a self-avoiding array of abrasive grain and for transferring such an array to an abrasive tool body are described.

20 Claims, 5 Drawing Sheets

U.S. PATENT DOCUMENTS

| | | | | |
|---|---|---|---|---|
| 6,096,107 | A | 8/2000 | Caracostas et al. | |
| 6,123,612 | A | 9/2000 | Goers | 451/540 |
| 6,159,087 | A | 12/2000 | Birang et al. | 451/526 |
| 6,286,498 | B1 | 9/2001 | Sung | 125/12 |
| 6,293,980 | B2 | 9/2001 | Wei et al. | |
| 6,347,982 | B1 | 2/2002 | Holzapfel | 451/56 |
| 6,358,133 | B1 | 3/2002 | Cesna et al. | 451/450 |
| 6,368,198 | B1 | 4/2002 | Sung et al. | 451/443 |
| 6,416,878 | B2 | 7/2002 | An | 428/565 |
| 6,511,713 | B2 | 1/2003 | Mathisen et al. | |
| 6,537,140 | B1 | 3/2003 | Miller et al. | |
| 6,572,446 | B1 | 6/2003 | Osterheld et al. | 451/24 |
| 6,575,353 | B2 | 6/2003 | Palmgren | |
| 6,679,243 | B2 | 1/2004 | Sung | |
| 6,769,975 | B2 | 8/2004 | Sagawa | |
| 6,818,029 | B2 | 11/2004 | Myoung et al. | |
| 7,124,753 | B2 * | 10/2006 | Sung | 125/12 |
| 7,258,708 | B2 | 8/2007 | Sung | |
| 2002/0068518 | A1 | 6/2002 | Cesena et al. | |
| 2002/0197947 | A1 | 12/2002 | Sagawa | 451/540 |
| 2003/0036341 | A1 | 2/2003 | Myoung et al. | 451/41 |

FOREIGN PATENT DOCUMENTS

| | | | |
|---|---|---|---|
| DE | 10296547 | T5 | 4/2004 |
| EP | 1020303 | A1 | 7/2000 |
| EP | 1208945 | A1 | 5/2002 |
| EP | 1297928 | A1 | 4/2003 |
| JP | 2002-178264 | | 6/2002 |
| JP | 2002178264 | A * | 6/2002 |
| JP | 2003-53665 | | 2/2003 |
| WO | 98/45092 | A1 | 10/1998 |

OTHER PUBLICATIONS

Li, Shin, Tomozawa & Murarka, The effect of the polishing pad treatments on the chemical-mechanical polishing of $SiO_2$ films; Thin Solid Films 270 (1995) pp. 601-606.

Stavreva, Zeidler, Plötner, & Drescher; Characteristics in chemical-mechanical polishing of copper: comparison of polishing pads; Applied Surface Science 108 (1997) pp. 39-44.

Chan, Wang, Teng, Sung, Pai Huang & Hwang; A preliminary study of gentle CVDD pad dressers potential for fixed abrasives conditioning; Nov. 19-20, 2002 VMIC Conference,2002 IMIC-400/00/0395; pp. 395-398.

Sung; CMP pad dresser: A diamond grid solution; DiaGrid® CMP Conditioner; pp. 0-41; Kinik Co., Taiwan.

Koshy, Iwasaki & Elbestawi; Surface generation with engineered diamond grinding wheels; Insights from simulation; McMaster Manufacturing Research Institute; McMaster University, Hamilton, Canada; pp. 271-274.

PCT International Search Report from International Application No. PCT/US2004/028881, mailed Dec. 23, 2004.

De Pellegrin, D. V. et al., "The Measurement and Description of Diamond Particle Shape in Abrasion," presented at a public meeting Apr. 19-20, 2007 and published in the proceedings of the meeting.

Elmufdi, C. L. et al., "The Impact of Pad Microtexture and Material Properties on Surface Contact and Defectivity in CMP," 11th International CMP Symposium, Lake Placid, NY, Aug. 15, 2006.

Hwang, T. et al., "Advanced Pad Conditioner Design for Oxide/Metal CMP," Transactions on Electrical and Electronic Materials, vol. 7, No. 2, pp. 62-66 (2006).

Hwang, T. et al., "Optimized and Customized CMP Conditioner Design for Next Generation Oxide/Metal CMP," published Oct. 25, 2007.

Lawing, A. S., "Pad Conditioning and Textural Effects in Chemical Mechanical Polishing," 2005 CMP-MIC Conference, Feb. 23-25, 2005 IMIC—1000P/C/0033, pp. 33-42.

English Translation of Austrian Office Action dated Feb. 14, 2008, from related Austrian Application No. 2B A 9375/2004, filed Sep. 7, 2004.

Canadian Office Action, dated Nov. 3, 2008, from corresponding Canadian Patent Application No. 2,540,733.

* cited by examiner

ABRASIVE TOOLS MADE WITH A SELF-AVOIDING ABRASIVE GRAIN ARRAY

RELATED APPLICATIONS

This application is a Continuation of U.S. application Ser. No. 10/683,486, filed on Oct. 10, 2003, now abandoned.

A method for designing and manufacturing abrasive tools and unique abrasives tools made by this method has been developed. In this method, individual abrasive grains are placed in a controlled, random spatial array such that the individual grains are non-contiguous. Having a random, but controlled, array of abrasive grains on an abrasive tool's abrading surface can yield optimum abrasive action, thereby improving efficiency and consistently generating planar workpiece surfaces.

BACKGROUND OF THE INVENTION

Uniform, patterned abrasive grain placement on various categories of abrasive tools has been found to improve abrasive tool performance. One such category of tools, the "engineered" or "structured" coated abrasive tools designed for fine, precision grinding operations, has become commercially available over the past decade. Typical designs for these coated abrasive tools are described in U.S. Pat. Nos. A-5,014,468, A-5,304,223, A-5,833,724, A-5,863,306 and 6,293,980B. In these tools, small, shaped composite structures, e.g., three-dimensional pyramids, diamonds, lines and hexagonal ridges, containing a plurality of abrasive grains held within bond material, are replicated as a single layer in a regular pattern on the surface of a flexible backing sheet. These tools have been found to engage in freer cutting, and the open spaces between the grain composites allow for cooler grinding and enhanced debris removal. Similar tools in the superabrasive tool category, having a rigid, shaped backing disc or core, are disclosed in U.S. Pat. No. 6,096,107.

Abrasive tools have been designed having a single layer of abrasive grains laid out in a uniform grid pattern of squares, circles, rectangles, hexagons, or other replicated geometric patterns and these tools have been used in a variety of precision finishing applications. A pattern may comprise individual grains or parcels of abrasive grains in a single layer, separated by open spaces between the parcels. Particularly among superabrasive tools, uniform patterns of abrasive grains are thought to render more planar, smoother surface finishes than can be achieved with random placement of abrasive grains on the abrasive tool. Such tools are disclosed, for example, in U.S. Pat. Nos. 6,537,140B1, A-5,669,943, A-4,925,457, A-5,980,678, A-5,049,165, 6,368,198B1 and A-6,159,087.

Thus, various abrasive tools have been designed and manufactured according to highly precise specifications required for the uniform abrasion of costly semi-finished workpieces. As an example of such workpieces in the electronics industry, semi-finished integrated circuits must be abraded or polished to remove excess ceramic or metal materials that have been selectively deposited in multiple surface layers, with or without etching, onto wafers (e.g., silica or other ceramic or glass substrate material). The planarization of newly formed surface layers on the semi-finished integrated circuits is done with chemical mechanical planarization (CMP) processes using abrasive slurries and polymeric pads. The CMP pads must be continuously or periodically "conditioned" with an abrasive tool. Conditioning eliminates pad hardening or glazing caused by the compression of accumulated debris and abrasive slurry particles into the polishing surface of the pads.

The conditioning action must be uniform across the surface of the pad so that the conditioned pad once again can planarize the semi-finished wafers across the entire surface of the wafers.

The location of abrasive grains on the conditioning tool is controlled to effect uniform scratch patterns on the polishing surface of the pad. Fully random placement of abrasive grain on a two-dimensional plane of the tool generally is considered unsuitable for CMP pad conditioning. It has been suggested to control the location of abrasive grains on CMP conditioning tools by orienting each grain along some defined uniform grid on the abrading surface of the tool. (See, for example, U.S. Pat. No. 6,368,198 B1.) However, uniform grid tools have certain limitations. For example, a uniform grid gives rise to a periodicity in vibration arising from the tool movement that, in turn, can cause waviness or periodic grooves on the pad or uneven wear of the abrasive tool or of the polishing pad, ultimately translating to inferior surfaces on the semi-finished workpiece.

A method for creating a non-uniform grid pattern of abrasive grains in a single layer on an abrasive tool substrate is disclosed in JP Pat. No. 2002-178264. In making these tools, one begins by defining a virtual grid having a uniform, two-dimensional pattern, such as a series of squares, wherein grains are to be placed at the intersections of lines on the grid. Then, one randomly selects some intersections along the grid and displaces grains from these intersections, moving the grains a distance of less than three times the average grain diameter. The method makes no provision for insuring the placement of individual grains in a numerical sequence along the x or y axis, thus failing to insure that the resultant tool surface can deliver consistent abrading action, without significant gaps or inconsistencies in the area of contact when the tool traces a linear path over a workpiece. The method also fails to insure a defined exclusionary zone around each abrasive grain, thus permitting both zones of concentrated grains and zones with gaps between grains that can cause non-uniform surface qualities in the finished workpiece.

Having none of these deficiencies of JP Pat. No. 2002-178264, the present invention permits one to manufacture abrasive tools having a defined exclusionary zone around each abrasive grain in a random, but controlled, two-dimensional array. Further, tools can be manufactured having a randomized numerical sequence of abrasive grain locations along the x and/or y axis of the grinding surface of the tool so as to create consistent abrading action, without significant gaps or inconsistencies in the area of contact, as the tool traces a linear path over the workpiece.

Prior art abrasive tools made with a uniform grid array of grains arranged by placing individual abrasive grains into interstitial voids of a template wire screen or perforated sheet (e.g., as in U.S. Pat. No. A-5,620,489) are limited to the static, uniform structural dimensions of such a grid. These wire screens and uniformly perforated sheets only can produce a tool design having a grid of regular dimensions (often a square or diamond grid). In contrast, tools of the invention may employ non-uniform distances, in a variety of lengths, between abrasive grits. Thus, vibration periodicity may be avoided. Freed from template screen dimensions, the cutting surface of the tool may contain a higher concentration of abrasive grain and may employ much finer abrasive grit sizes while still controlling grain placement. For CMP pad conditioning, it is believed that the higher the concentration of abrasive grains on the abrasive tool, the greater the number of abrasive points in contact with the pads and the higher the efficiency of removal of accumulated oxide debris and other glazing materials from the polishing surface of the pads.

Because CMP pads are relatively soft, small abrasive grit sizes are suitable for use in this application and one may use relatively higher concentrations of a smaller grit size abrasive grain.

Furthermore, in peripheral grinding operations carried out with the tools of the invention, each grain in the controlled, random array of non-contiguous abrasive grains will trace different, self-avoiding paths or lines along the surface of the workpiece as it moves in a linear fashion. This contrasts favorably with prior art tools having a uniform grid array of abrasive grains. In a uniform grid, each grain sharing the same x or y dimension on the grid will trace along the surface of the workpiece in the same path or line traced by all other grains lying at the same x or y dimension which also traverse the pad. In this manner, the uniform grid tools of the prior art tend to create "trenches" on the surface of the workpiece. The tools of the invention minimize these problems. Tools operated in a rotary fashion rather than in a linear fashion present a different situation. With a "face" or surface grinding tool, regular arrays of grain have multi-fold rotational symmetry, (e.g., a square uniform grid has a four-fold rotational symmetry, hexagonal has six-fold, etc.) whereas the tools of the invention have only one-fold rotational symmetry. Thus, the repeat cycle of the tools of the invention is much longer (e.g., 4 times longer than a square, uniform grid) with the net effect that the tools of the invention minimize the creation of regular patterns on the workpiece, relative to tools having a regular uniform array of abrasive grain.

In addition to benefits realized in peripheral grinding and CMP pad conditioning, the abrasive tools of the invention offer benefits in various manufacturing processes. These processes include, for example, abrading other electronic components, e.g., backgrinding ceramic wafers, finishing optical components, finishing materials characterized by plastic deformation and grinding "long chipping" materials, e.g., titanium, Inconel alloys, high tensile steel, brass and copper.

While the invention is particularly useful in making tools having a single layer of abrasive grain on a planar work surface, a two-dimensional grain array may be bent or formed into a hollow three-dimensional cylinder and thereby adapted for use on tools constructed as a cylindrical three-dimensional array of abrasive grain held on the surface of the tool (e.g., rotary dressing tools). The abrasive grain array may be converted from a two-dimensional sheet or structure to a solid, three-dimensional structure by rolling the sheet bearing the bonded abrasive grain array into a concentric roll, thus creating a spiral structure in which each grain is randomly offset from each adjacent grain in the z direction and all grains are non-contiguous in the x, y and z direction. The invention also is useful in making many other sorts of abrasive tools. These tools include, for example, surface grinding disks, edge grinding tools comprising a rim of abrasive grain around the perimeter of a rigid tool core or hub, and tools comprising a single layer of abrasive grain or abrasive grain/bond composite on a flexible backing sheet or film.

SUMMARY OF THE INVENTION

The invention relates to a method for manufacturing abrasive tools having a selected exclusionary zone around each abrasive grain, comprising the steps of:

(a) selecting a two-dimensional planar area having a defined size and shape;

(b) selecting a desired abrasive grain grit size and concentration for the planar area;

(c) randomly generating a series of two-dimensional coordinate values;

(d) restricting each pair of randomly generated coordinate values to coordinate values differing from any neighboring coordinate value pair by a minimum value (k);

(e) generating an array of the restricted, randomly generated coordinate values having sufficient pairs, plotted as points on a graph, to yield the desired abrasive grain concentration for the selected two dimensional planar area and the selected abrasive grain grit size; and (f) centering an abrasive grain at each point on the array.

The invention relates to a second method for manufacturing abrasive tools having a selected exclusionary zone around each abrasive grain, comprising the steps of:

(a) selecting a two-dimensional planar area having a defined size and shape;

(b) selecting a desired abrasive grain grit size and concentration for the planar area;

(c) selecting a series of coordinate value pairs $(x_1, y_1)$ such that the coordinate values along at least one axis are restricted to a numerical sequence wherein each value differs from the next value by a constant amount;

(d) decoupling each selected coordinate value pair $(x_1, y_1)$ to yield a set of selected x values and a set of selected y values;

(e) randomly selecting from the sets of x and y values a series of random coordinate value pairs (x, y), each pair having coordinate values differing from coordinate values of any neighboring coordinate value pair by a minimum value (k);

(f) generating an array of the randomly selected coordinate value pairs having sufficient pairs, plotted as points on a graph, to yield the desired abrasive grain concentration for the selected two dimensional planar area and the selected abrasive grain grit size; and (g) centering an abrasive grain at each point on the array.

The invention also relates to abrasive tool comprising abrasive grains, bond and a substrate, the abrasive grains having a selected maximum diameter and a selected size range, and the abrasive grains being adhered in a single layer array to the substrate by the bond, characterized in that:

(a) the abrasive grains are oriented in the array according to a non-uniform pattern having an exclusionary zone around each abrasive grain, and (b) each exclusionary zone has a minimum radius that exceeds the maximum radius of the desired abrasive grain grit size.

DESCRIPTION OF THE PREFERRED EMBODIMENTS

In making the tools of the invention, one begins by generating a two dimensional graphic plot to direct the placement of the center of the longest dimension of each abrasive grain on one point of a controlled random spatial array consisting of non-contiguous points. The dimension of the array and the number of points selected for the array are dictated by the desired abrasive grain grit size and grain concentration on the two dimensional planar area of a grinding or polishing face of the abrasive tool being manufactured. The graphic plot may be generated by any known means for generating a two-dimensional plot, including, for example, manual mathematical calculations, CAD drawings and computer algorithms (or "macros"). In a preferred embodiment, a macro running in a Microsoft® Excel® software program is used to generate the graphic plot.

Generating a Graph of a Self-avoiding Array of Abrasive Grain

Figure 3:
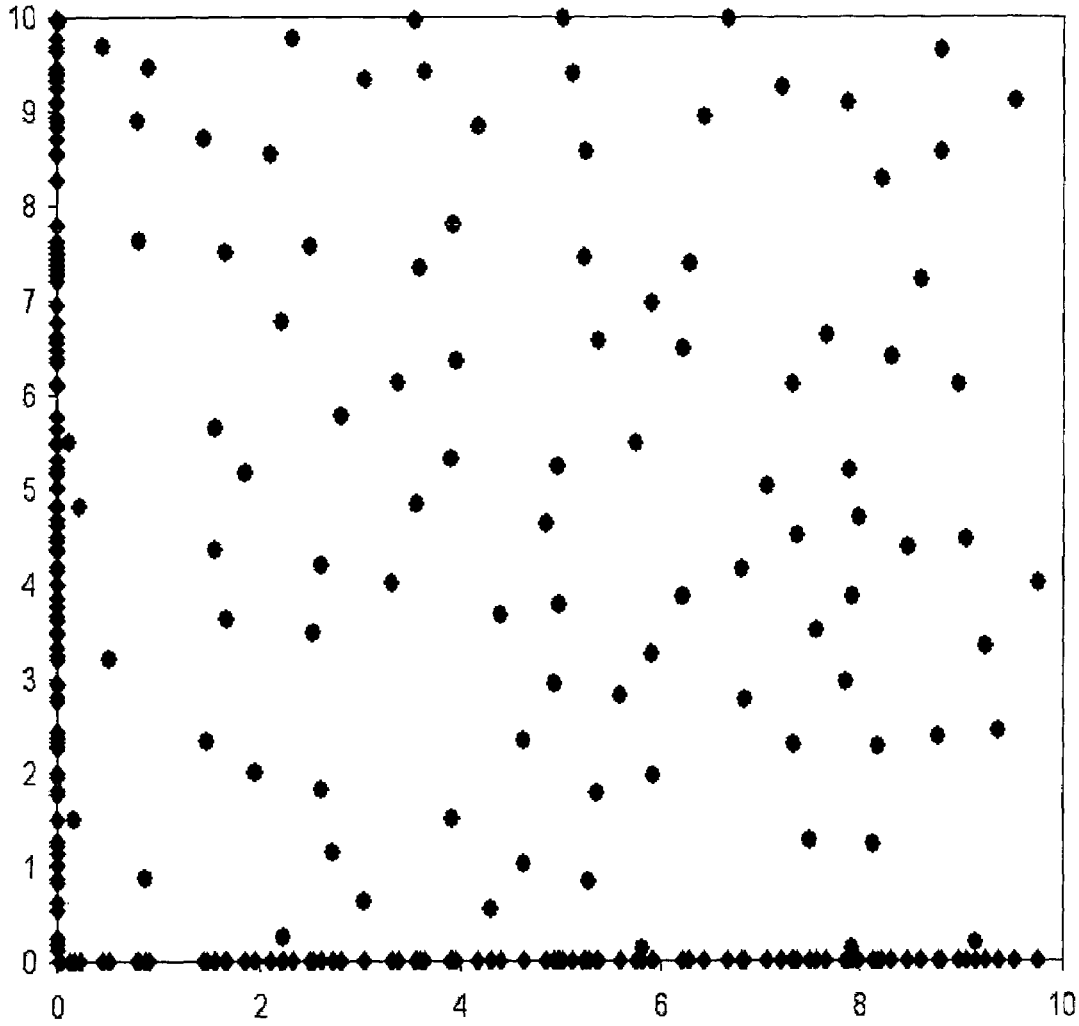
FIG. 3 is an illustration of a graph of an abrasive grain array of the invention, showing a random array of x, y coordinate values which have been restricted such that each pair of randomly generated coordinate values differs from the nearest coordinate value pair by a defined minimum amount (k) to create an exclusionary zone around each point on the graph.

In one embodiment of the invention, the following macro created in Microsoft Excel software (2000 version) was used to generate points on a two dimensional grid, forming the array of points for locating individual abrasives grains on a tool surface that is illustrated in FIG. 3.

Macro for generating FIG. 3

```
(Dim = dimension; rnd = random)
Dim X(10000)
Dim y(10000)
Dim selectx(10000)
Dim selecty(10000)
b = 2
'Picks the first xy pair (on a 0-10 grid) at random and writes the values
Randomize
X1 = Rnd * 10
Y1 = Rnd * 10
Worksheets("Sheet1").Cells(1, 1).Value = X1
Worksheets("Sheet1").Cells(1, 2).Value = Y1
'Adds the first xy pair to the selected list
selectx(1) = X1
selecty(1) = Y1
'Picks the next xy pair
For counter = 2 To 10000
X(counter) = Rnd * 10
y(counter) = Rnd * 10
'Makes sure subsequent points are a distance > x away
For a = 1 To b
If ((X(counter) – selectx(a)) ^ 2 + (y(counter) – selecty(a)) ^ 2) ^ 0.5 <
0.5 Then GoTo 20
Next a
'The flag "failed" counts the number of random points that failed to make
the grid
failed = 0
selectx(b) = X(counter)
selecty(b) = y(counter)
Worksheets("Sheet1").Cells(b, 1).Value = selectx(b)
Worksheets("Sheet1").Cells(b, 2).Value = selecty(b)
b = b + 1
'If 1000 successive attempts fail to make the grid we give up, it is full
20 failed = failed + 1
If failed = 1000 Then End
Next counter'
End Sub
```

Figure 4:
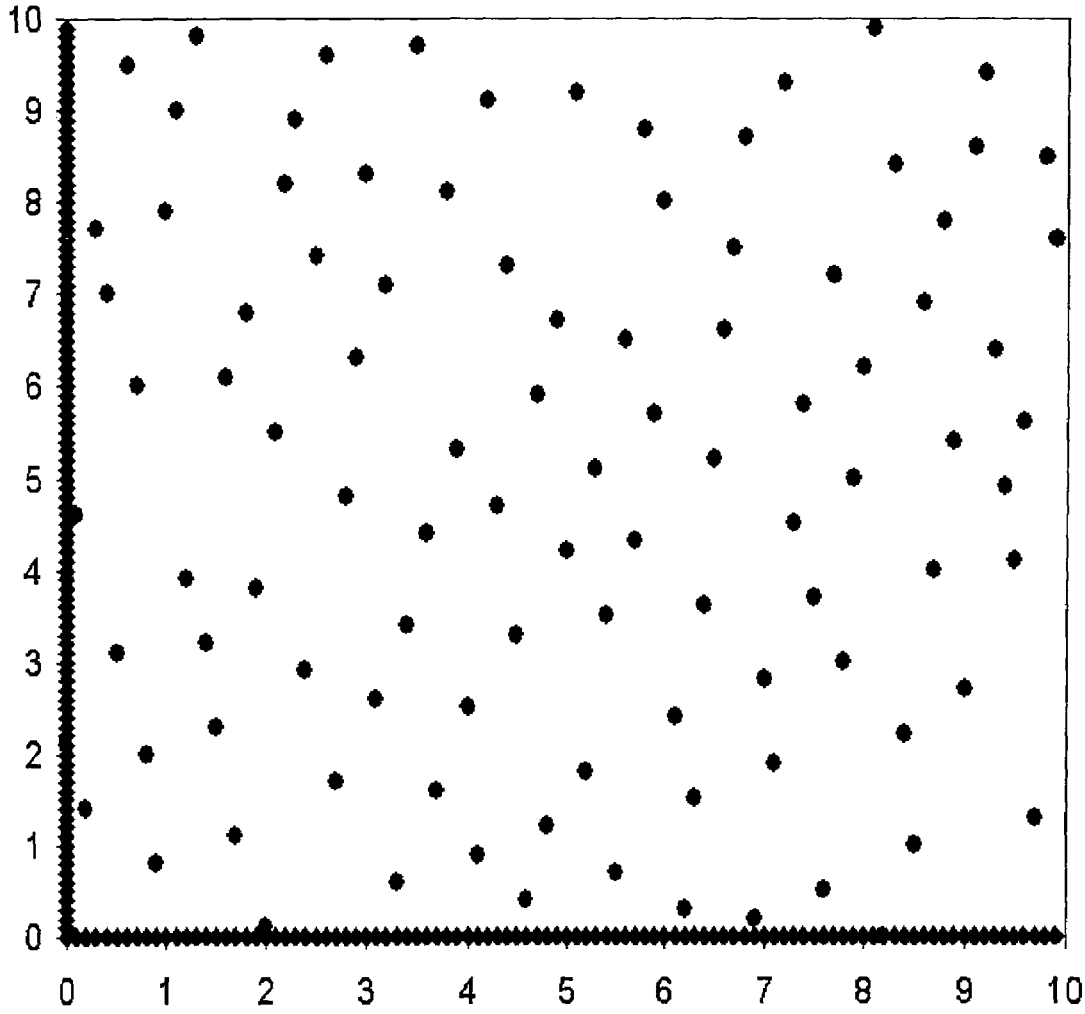
FIG. 4 is an illustration of a graph of an abrasive grain array of the invention, showing an array that has been restricted along the x and y axes to numerical sequences wherein each coordinate value on an axis differs from the next coordinate value by a constant amount. The array has been restricted further by decoupling coordinate value pairs, and randomly reassembling the pairs such that each randomly reassembled pair of coordinate values is separated from the nearest pair of coordinate values by a defined minimum amount.

In another embodiment of the invention, the following macro created in Microsoft Excel software (2000 version) was used to generate points on a two dimensional grid, forming the array of points for locating individual abrasive grains on a tool surface that is illustrated in FIG. 4. In this illustration, coordinate values were selected in a numerical sequence along both the x and y axes.

Macro for generating FIG. 4

```
(Dim = dimension; Q = count of number of points or calculations;
rand = random)
Dim x(1000)
Dim rand x(1000)
Dim Y(1000)
Dim rand y(1000)
Dim z(1000)
Dim x flag(1000)
Dim y flag(1000)
Dim picked x(1000)
Dim picked y(1000)
failed = –1
2
For Q = 2 To 101
x flag(Q) = 0
y flag(Q) = 0
Next Q
    Cells.Select
    With Selection
        .Horizontal Alignment = xl Center
        .Vertical Alignment = xl Bottom
        .Wrap Text = False
        .Orientation = 0
        .Add Indent = False
        .Shrink To Fit = False
        .Merge Cells = False
    End With
Worksheets("sheet1").Cells(1, 2).Value = " X values "
Worksheets("sheet1").Cells(1, 5).Value = " Y values "
Worksheets("sheet1").Cells(1, 3).Value = " Rand X values "
Worksheets("sheet1").Cells(1, 6).Value = " Rand Y values "
Worksheets("sheet1").Cells(1, 11).Value = " Avoiding X "
Worksheets("sheet1").Cells(1, 12).Value = " Avoiding Y "
Worksheets("sheet1").Cells(1, 8).Value = "   X   "
Worksheets("sheet1").Cells(1, 9).Value = "   Y   "
Worksheets("sheet1").Cells(3, 13).Value = " No. of Failed Tries "
Worksheets("Sheet1").Range("A1:L1").Columns.AutoFit
Worksheets("Sheet1").Range("A1:L1").Font.Bold = True
Worksheets("Sheet1").Columns("C").__
    NumberFormat = "0.0000__)"
Worksheets("Sheet1").Columns("F").__
    NumberFormat = "0.0000__)"
x counter = 1
For XX = 0 To 9.9 Step 0.1
x counter = x counter + 1
x(x counter) = XX
Randomize
Rand x(x counter) = Rnd
Worksheets("sheet1").Cells(xcounter, 2).Value = x(xcounter)
Worksheets("sheet1").Cells(xcounter, 3).Value = randx(xcounter)
Next XX
    Range("B2:C101").Select
    Selection.Sort Key1:=Range("C1"), Order1:=xlAscending,
    Header:=xlGuess,__
        OrderCustom:=1, MatchCase:=False, Orientation:=
        xlTopToBottom
ycounter = 1
For YY = 0 To 9.9 Step 0.1
ycounter = ycounter + 1
Y(ycounter) = YY
Randomize
randy(ycounter) = Rnd
Worksheets("sheet1").Cells(ycounter, 5).Value = Y(ycounter)
Worksheets("sheet1").Cells(ycounter, 6).Value = randy(ycounter)
Next YY
    Range("E2:F101").Select
    Selection.Sort Key1:=Range("F2"), Order1:=xlAscending,
    Header:=xlGuess,__
        OrderCustom:=1, MatchCase:=False, Orientation:=
        xlTopToBottom
```

-continued

```
For counter = 2 To 101
x(counter) = Worksheets("sheet1").Cells(counter, 2)
Y(counter) = Worksheets("sheet1").Cells(counter, 5)
Next counter
For counter = 2 To 101
Worksheets("sheet1").Cells(counter, 8).Value = x(counter)
Worksheets("sheet1").Cells(counter, 9).Value = Y(counter)
Next counter
Worksheets("sheet1").Cells(2, 11).Value = x(2)
Worksheets("sheet1").Cells(2, 12).Value = Y(2)
pickedx(1) = x(2)
pickedy(1) = Y(2)
'Make sure points are not too close to each other
accepted = 1
For xcounter = 3 To 101
For ycounter = 3 To 101
'makes sure x and y values have not been used before
If xflag(xcounter) = 1 Or yflag(ycounter) = 1 Then GoTo 10
XX = x(xcounter)
YY = Y(ycounter)
'Sets inter-point distance to some value range
For a = 1 To accepted
If ((XX - pickedx(a)) ^ 2 + (YY - pickedy(a)) ^ 2) ^ 0.5 < 0.7 Then
GoTo 10
Next
b = accepted + 2
Worksheets("sheet1").Cells(b, 11).Value = XX
Worksheets("sheet1").Cells(b, 12).Value = YY
xflag(xcounter) = 1
yflag(ycounter) = 1
accepted = accepted + 1
pickedx(a) = XX
pickedy(a) = YY
10 Next ycounter
20 Next xcounter
'This block resets the algorithm if the number of accepted
'points is too low. maximum effort is 500 loops.
failed = failed + 1
Worksheets("sheet1").Cells(4, 13).Value = failed
If failed = 500 Then GoTo 50
If accepted < 100 Then GoTo 2
GoTo 60
50
Worksheets("sheet1").Cells(2, 13).Value = "Failed to Place all Points"
60
End Sub
```

Figure 1:
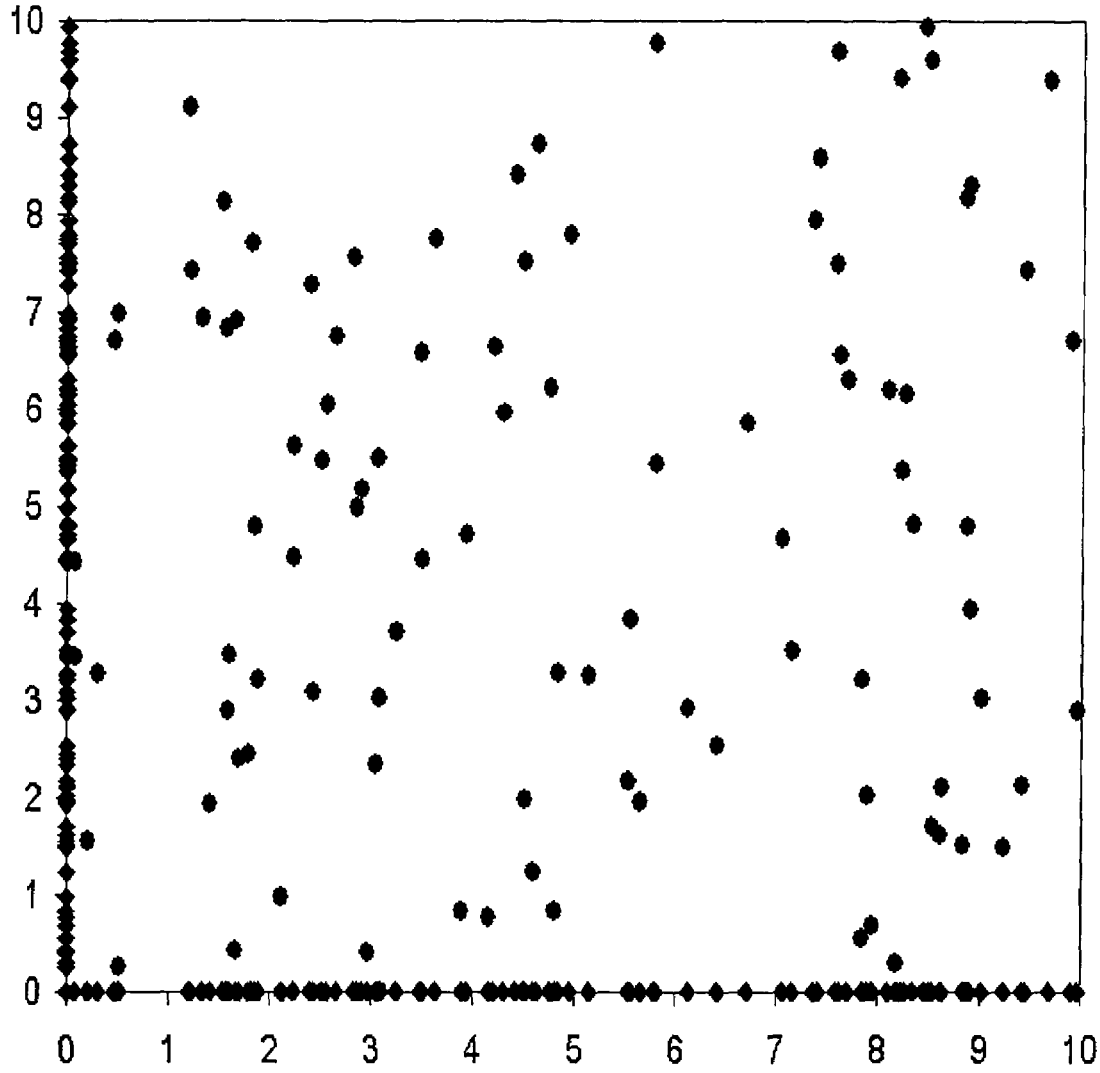
Figure 1 Prior Art
FIG. 1 is an illustration of a graph of a prior art tool grain distribution corresponding to randomly generated x, y coordinate values and showing irregular distribution along the x and y axes.

FIG. 1 illustrates a prior art random distribution of 100 points on a 10×10 planar grid generated with a random number function of a Microsoft® Excel® 2000 software program. Along the x and y axes (illustrated as diamond shapes), are the locations where the coordinate points (illustrated as circular shapes) intercept the axis. For instance, the (x, y) point (3.4, 8.6) would be represented on the x axis at (3.4, 0.0) and on the y axis at (0.0, 8.6). It is seen that there are regions where these points are clustered and regions devoid of points. Such is the nature of a random distribution.

Figure 2:
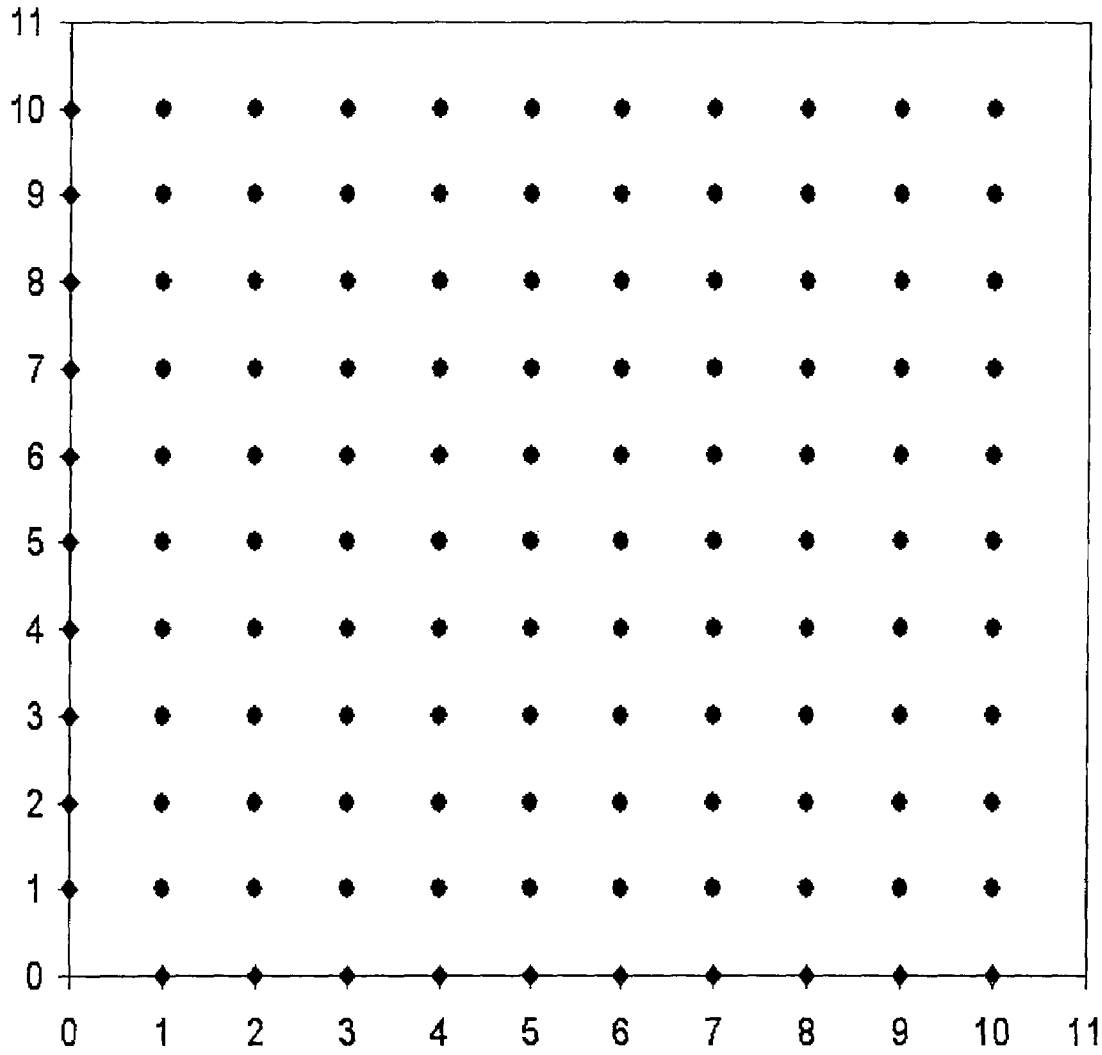
Figure 2 Prior Art
FIG. 2 is an illustration of a graph of a prior art tool grain distribution corresponding to a uniform grid of x, y coordinate values and showing regular gaps between consecutive coordinate values along the x and y axes.

FIG. 2 shows a completely ordered prior art point array, with points spaced at equal intervals along both the x and y axis to generate a square grid array. In this instance, although the diamond-shaped points along the x and y axis are uniformly spaced, they are a large distance apart. A significant improvement can be made by offsetting the particle array slightly along a diagonal direction with respect to the x and y axis. In such a case, each grain particle is offset, such that in the square array, point (x, y) now becomes (x+0.1y, y+0.1x). This improves the "point density" along both the axis by a factor of x 10, the points are now x 10 closer to each other. However, the array is still ordered and as such will create the periodic vibrations that are undesirable when operating abrasive tools.

FIG. 3, illustrating an embodiment of the invention and generated with the macro detailed above, shows a distribution of 100 randomly selected coordinate points on a 10×10 grid, having applied a restriction that no two points may be closer than 0.5. The number of random points that can be placed on a 10×10 grid as a function of the minimum allowed point separation is shown in Table 1.

TABLE 1

The number of points placed as a function of the minimum point separation. If 1000 successive attempts to place a point failed, calculations were stopped.

| Minimum Point Separation | Average Number of Points (five runs) |
|---|---|
| 0.5 | 257 |
| 0.6 | 183.2 |
| 0.7 | 135.6 |
| 0.8 | 108.8 |
| 0.9 | 86.8 |
| 1.0 | 71.4 |

Note that the space in FIG. 3 is not full and it only shows 100 points, but the space can (on average) support another 157 points with a minimum point separation of 0.5. Once the largest diameter of the abrasive grain has been selected, the maximum grain concentration may be readily determined for a given planar area.

FIG. 4 illustrates another embodiment of the invention, showing a plotted array generated with the macro detailed above. The grid of Cartesian coordinate points shown in FIG. 4 produces a uniform point density along the x and y axis. The points are randomly chosen from two sets of decoupled coordinate point values (x) and (y), wherein the x axis values follow a regular, numbered sequence, and the y axis values follow a regular, numbered sequence. Having been created from decoupled and randomly reassembled pairs of x, y values, this spatial array represents a significant departure from both an ordered lattice array and a random array. The graph in FIG. 4 includes the further restriction of an exclusionary zone requirement, whereby no two points may be within a certain distance of each other, in this case 0.7.

The point distribution shown in FIG. 4, was achieved as follows:

a) A list of x points and a list of y points were prepared. In this case both were 0.0, 0.1, 0.2, 0.3, . . . 9.9.

b) A random number was assigned to each x and each y value. The random numbers were sorted in ascending order along with their associated x or y values. This step simply randomized the x points and the y points.

c) The first (x, y) point was picked and placed on the grid. A second $(x_i, y_i)$ point was selected.

f) The point $(x_i, y_i)$ was added to the grid only if it was further than some specified distance from any existing point on the grid.

g) If the point $(x_i, y_i)$ did not meet the distance criteria, it was rejected and the point $(x_i, y_i)$ attempted. A grid was considered acceptable only if all the points could be placed.

With the step distance in x and y being 0.1, it was found that a grid was accepted on the first attempt if the minimum point spacing was 0.4 or less. If the minimum point spacing was 0.5 or 0.6, a number of attempts were necessary to place all the points. The maximum spacing that allowed placing of all the points was 0.7, and often several hundred attempts were necessary before placing all the points.

Figure 5:
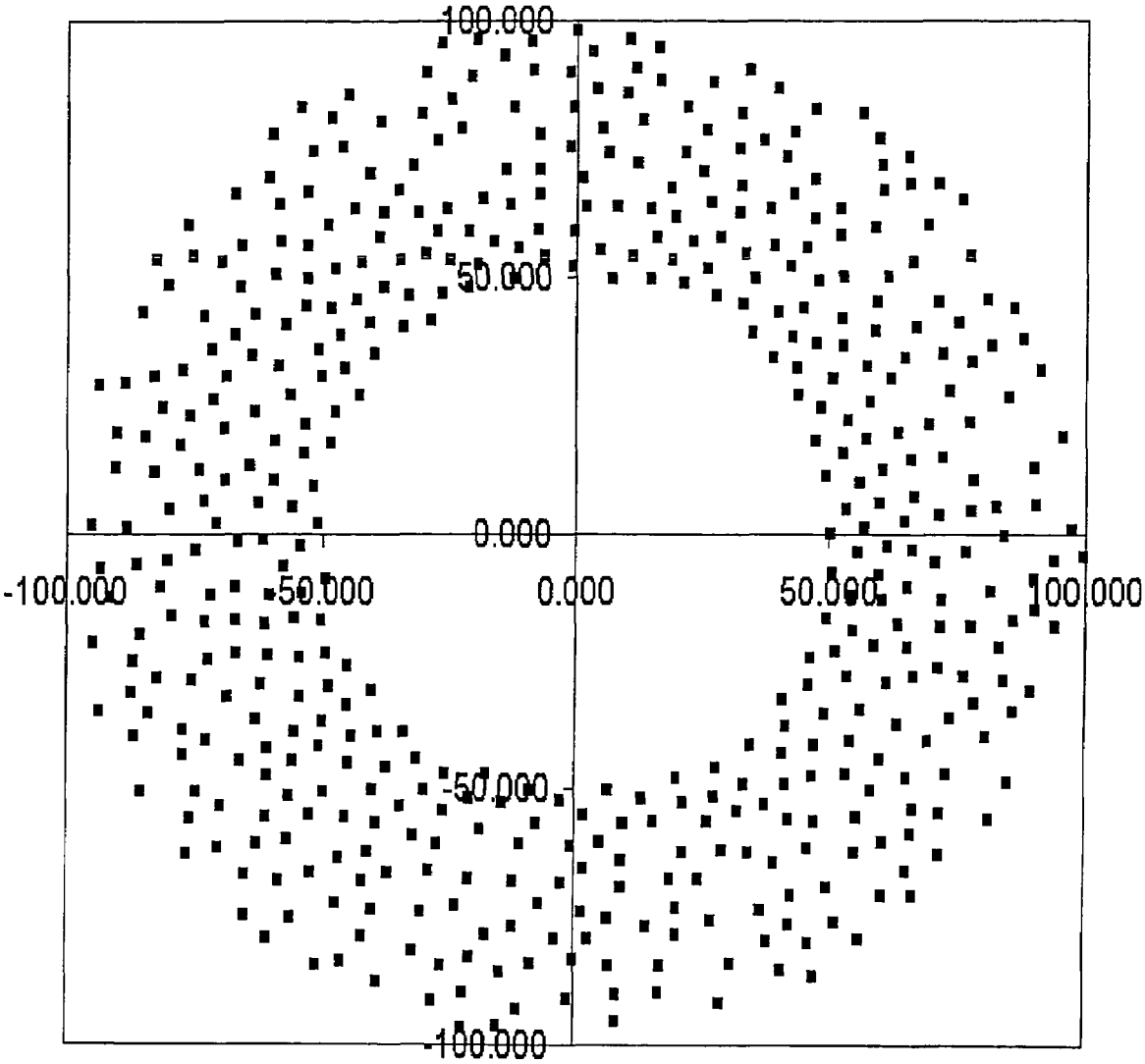
FIG. 5 is an illustration of a graph of an abrasive grain array of the invention, plotted with r, θ polar coordinates in a ring shaped planar area.

FIG. 5 illustrates another embodiment of the invention, generated with a macro similar to the macro used to generate FIG. 4; however, the distribution of points in FIG. 5 was generated with polar coordinates r, θ. A ring was chosen as the planar area, and points were placed on the array such that any radial line drawn from the center point (0,0) intercepts a uniform point distribution.

Because the radial dimension directs the placement of more points near the center of the ring and fewer points near the perimeter of the ring and the perimeter encompasses a larger area than the center, the density of points per unit area is not uniform. In a tool made with such an array, the abrasive grains located nearer the perimeter will have to grind a larger area and will wear more quickly. To avoid such a disadvantage and to create uniformly dense abrasive grain distribution, a second, Cartesian array can be generated and superimposed upon the polar coordinate array. A macro and an array of the sort illustrated in FIG. 3 can be used for this purpose. With the exclusionary zone restriction, the superimposed Cartesian array will avoid placing points in the densely populated central area of the ring, but will uniformly fill in open areas nearer the perimeter.

The relative distributions of intercept values shown as diamond shapes on the various graphs shown in the Figures may be compared in order to predict tool performance for abrasive tools being moved in a linear path during grinding. An abrasive tool having multiple grains located at one (or more) identical intercept value will trace a path of uneven coverage (e.g., the prior art tool of FIG. 2). Gaps in abrading action will be interspersed with grinding tracks that have become deep trenches as a result of multiple grains traversing the same location. Thus, the diamond shaped points along the axes in FIGS. 1-4 suggest how abrasive tools will perform when moved in a linear direction across the plane of a workpiece. FIGS. 1 and 2, illustrating prior art tools, have clumps and gaps among the diamond shaped intercept values. FIGS. 3-4, illustrating the invention, have relatively few, if any, clumps or gaps among the diamond shaped intercept values. For this reason, tools made with the abrasive grain arrays shown in FIGS. 3-5 can grind surfaces to a smooth, uniform, relatively defect-free finish.

The size of the exclusionary zone around each grain may vary from grain to grain and does not have to be the same value (i.e., the minimum value (k) defining the distance between the center-point of adjacent grains may be a constant or a variable). In order to create an exclusionary zone, the minimum value (k) must exceed the maximum diameter of the desired size range of abrasive grain. In a preferred embodiment, the minimum value (k) is at least 1.5 times the maximum diameter of the abrasive grain. The minimum value (k) must avoid any grain-to-grain surface contact and provide channels between grains sized sufficiently large to permit removal of grinding debris from the grains and the tool surface. The dimension of the exclusionary zone will be dictated by the nature of the grinding operation, with work materials that generate large chips needing tools that have larger channels between adjacent abrasive grains and larger exclusionary zone dimensions than work materials that generate fine chips.

Making an Abrasive Tool Using a Graph of a Self-avoiding Array

The two-dimensional array of controlled random points may be transferred to a tool substrate or to a template for abrasive grain placement by a variety of techniques and equipment. These included, for example, automated robotic systems for orienting and placing objects, graphic image (e.g., CAD blueprint) transfers to laser cutting or photo-resist chemical etching equipment for making templates or dies, laser or photo-resist equipment for direct application of the array onto a tool substrate, automated adhesive dot dispensing equipment, mechanical punch equipment and the like.

As used herein, "tool substrate" refers to a mechanical backing, core or rim onto which the array of abrasive grain is adhered. A tool-substrate may be selected from various rigid tool pre-forms and flexible backings. Substrates that are rigid tool pre-forms preferably have a geometric shape having one axis of rotational symmetry. The geometric shape may be simple or it may be complex, it in that it may include of a variety of geometric shapes assembled along the axis of rotation. In these categories of abrasive tools, preferred geometric shapes or forms of the rigid tool pre-forms include disk, rim, ring, cylinder and frustoconical shapes, together with combinations of these shapes. These rigid tool pre-forms may be constructed from steel, aluminum, tungsten or other metals, and metal alloys and composites of these materials with, e.g., ceramic or polymeric materials, and other materials having sufficient dimensional stability for use in constructing abrasive tools.

Flexible backing substrates include films, foils, fabrics, non-woven sheets, webs, screens, perforated sheets, and laminates, and combinations thereof, together with any other types of backings known in the art of making abrasive tools. The flexible backings may be in the form of belts, discs, sheets, pads, rolls, ribbons or other shapes, such as are used, e.g., for coated abrasive (sand paper) tools. These flexible backings may be constructed from flexible paper, polymeric or metallic sheets, foils or laminates.

Abrasive grain arrays may be adhered to the tool substrate by a variety of abrasive bonding materials, such as are known in the manufacture of bonded or coated abrasive tools. Preferred abrasive bonding materials include adhesive materials, brazing materials, electroplating materials, electromagnetic materials, electrostatic materials, vitrified materials, metal powder bond materials, polymeric materials and resin materials, and combinations thereof.

In a preferred embodiment, the non-contiguous point array may be applied or imprinted onto the tool substrate such that abrasive grains are bonded directly onto the substrate. Direct transfer of the array onto the substrate may be carried out by placing an array of adhesive droplets or metallic braze paste droplets on the substrate and then centering an abrasive grain on each droplet. In an alternative technique, a robotic arm may be used to pick an array of abrasive grains, with a single grain held at each point of the array, and the robotic arm then may place the array of grains on a tool surface that has been pre-coated with a surface layer of adhesive or metallic braze paste.

The adhesive or metallic brazed paste temporarily fixes in the location of the abrasive grains until the assembly has been further processed to permanently fix the center of each abrasive grain to each point of the array.

Suitable adhesives for this purpose include, e.g., epoxy, polyurethane, polyimide, and acrylate compositions and modifications and combinations thereof. Preferred adhesives have non-Newtonian (shear-thinning) properties to allow sufficient flow during placement of droplets or coatings, yet inhibit flow so as to maintain precision in the location of the abrasive grain array. Adhesive open time characteristics may be selected to match the timing of the remaining manufacturing steps. Rapidly curing adhesives (e. g., with a UV radiation cure) are preferred for most manufacturing operations.

In a preferred embodiment, Microdrop® equipment available from Microdrop GmbH, Norderstedt, Germany, may be used to deposit an array of adhesive droplets onto the surface of the tool substrate.

The surface of the tool substrate may be indented or scored to aid in direct placement of the abrasive grain onto the points of the array.

In an alternative to direct placement of the array onto the tool substrate, the array may be transferred or imprinted onto a template, and abrasive grains adhered to the array of points on the template. The grains may be adhered to the template by permanent or by temporary means. The template functions either as a holder for grains oriented on the array or as a means for the permanent orientation of the grains in the final abrasive tool assembly.

In a preferred method, the template is inscribed with an array of indentations or perforations corresponding to the desired array, and abrasive grains are temporarily affixed to the template by means of a temporary adhesive or by application of a vacuum or by an electromagnetic force, or by electrostatic force, or by other means, or by a combination or a series of means. The abrasive grain array may be dislodged from the template onto the surface of the tool substrate and the template then removed, while insuring the grains remain centered at selected points of the array such that the desired pattern of grain is created on the substrate.

In a second embodiment, a desired array of points of positioning adhesive (e.g., a water soluble adhesive) may be created on a template (by means of a mask or by an array of microdrops) and then an abrasive grain may be centered on each point of the positioning adhesive. The template is then placed on a tool substrate coated with a bonding material (e.g., a water insoluble adhesive) and the grain is released from the template. In the case of a template made of an organic material, the assembly may be thermally treated (e.g., at 700-950° C.) to braze or sinter the metal bond used to adhere grains to the substrate, whereby the template and positioning adhesive is removed by thermal degradation.

In another preferred embodiment, the array of grains being adhered to the template may be pressed against the template to uniformly align the array of grain according to height, and then the array may be bonded to the tool substrate such that the tips of the bonded grains are a substantially uniform height from the tool substrate. Suitable techniques for carrying out this process are known in the art and described, for example, in U.S. Pat. Nos. A-6,159,087, A-6,159,286 and 6,368,198 B1, the contents of which are incorporated by reference.

In an alternative embodiment, abrasive grains are permanently affixed to the template and the grain/template assembly is mounted onto the tool substrate with an adhesive bond, braze bond, electroplated bond or by other means. Suitable techniques for carrying put this process are known in the art and disclosed, for example, in U.S. Pat. Nos. A-4,925,457, A-5,131,924, A-5,817,204, A-5,980,678, A-6,159,286, 6,286,498 B1 and 6,368,198 B1, the contents of which are hereby incorporated by reference.

Other suitable techniques for assembling abrasive tools made with the self-avoiding abrasive grain arrays of the invention are disclosed in U.S. Pat. Nos. A-5,380,390 and A-5,620,489, the contents of which are hereby incorporated by reference.

Techniques described above for making abrasive tools incorporating non-contiguous abrasive grains arranged in controlled, random spatial arrays may be employed in the manufacture of many categories of abrasive tools. Among these tools are dressing or conditioning tools for CMP pads, tools for back grinding electronic components, grinding and polishing tools for ophthalmic processes such as finishing lens surfaces and edges, rotary dressers and blade dressers for refurbishing the working face of grinding wheels, abrasive milling tools, complex geometry superabrasive tools (e.g., electroplated CBN grain wheels for high speed creep feed grinding), grinding tools for rough grinding of "short chipping" materials, such as Si3N4, having a tendency to generate fine, easily packed, waste particles that clog grinding tools and grinding tools used to finish "long chipping" materials, such as titanium, Inconel alloys, high tensile steel, brass and copper, having a tendency to form gummy chips that smear the face of the grinding tool.

Such tools may be made with any abrasive grain known in the art, including for example, diamond, cubic boron nitride (CBN), boron suboxide, various alumina grains, such as fused alumina, sintered alumina, seeded or unseeded sintered sol gel alumina, with or without added modifiers, alumina-zirconia grain, oxy-nitride alumina grains, silicon carbide, tungsten carbide and modifications and combinations thereof.

As used herein, "abrasive grain" refers to single abrasive grits, cutting points, and composites comprising a plurality of abrasive grits, and combinations thereof. Any bond used in making abrasive tools may be employed to bond the array of abrasive grain to the tool substrate or template. For example, suitable metal bonds include bronze, nickel, tungsten, cobalt, iron, copper, silver and alloys and combinations thereof. Metal bonds may be in the form of a braze, electroplated layer, a sintered metal powder compact or matrix, a solder, or a combination thereof, together with optional additives such as a secondary infiltrant, hard filler particles and other additives to enhance manufacturing or performance. Suitable resin or organic bonds include epoxy, phenol, polyimide and other materials, and combinations of materials used in the art of bonded and coated abrasive grains to make abrasive tools. Vitrified bond materials, such as glass precursor mixtures, powdered glass frits, ceramic powders and combinations thereof, may be used in combination with an adhesive binder material. This mixture may be applied as a coating on a tool substrate or printed as a matrix of droplets on the substrate, e.g., in the manner described in JP 99201524, the contents of which are hereby incorporated by reference.

EXAMPLE 1

A CMP pad conditioning tool with self avoiding abrasive grain placement is fabricated by first coating a disk shaped steel substrate (4 inch diameter round plate; 0.3 in thick) with a braze paste. The braze paste contains a brazing filler metal alloy powder (LM Nicrobraz®, obtained from Wall Colmonoy Corporation,) and a water-based, fugitive organic binder (Vitta Braze-Gel binder, obtained from Vitta Corporation) consisting of 85% by weight binder and 15% by weight of tripropylene glycol. The braze paste contains 30% by volume binder and 70% by volume metal powder. Braze paste is coated on the disk to a uniform thickness of 0.008 inch, by means of a doctor blade.

Diamond abrasive grain (100/200 mesh, FEPA size D151, MBG 660 diamond obtained from GE Corporation, Worthington, Ohio) is screened to an average diameter of 151/139 microns. A vacuum is applied to a pickup arm equipped with a 4 inch, disk-shaped steel template bearing the self-avoiding array pattern illustrated in FIG. 4. The pattern is present as an array of perforations sized 40-50% smaller than the average diameter of the abrasive grain. The template mounted on the pick up arm is positioned over the diamond grains, a vacuum is applied to adhere a diamond grain to each perforation, excess grains are brushed off the template surface, leaving only one diamond in each perforation, and the diamond-bearing template is positioned over the braze coated tool substrate. The vacuum is released after each diamond has been contacted with the surface of the braze paste while the paste is still wet, thereby transferring the diamond array onto the braze paste. The paste temporarily bonds the diamond array, fixing the grains in place for further processing. The assembled tool is then dried at room temperature and brazed in a vacuum oven for 30 minutes at a temperature of about 980-1060° C., to permanently bond the diamond array to the substrate.

EXAMPLE 2

A diamond wheel (type 1A1 wheel; 100 mm diameter, 20 mm thick with a 25 mm bore) for ophthalmic rough grinding operations having a pseudo-random distribution of a single layer of diamond abrasive grains according to the self-avoiding array pattern illustrated in FIG. 3 is manufactured in the following manner. One of two methods is used for the transfer of the array onto the tool substrate (pre-form).

Method A:

Using the imprint of the abrasives grain array of FIG. 3, holes up to 1.5 times bigger in diameter than the average grain diameter are made in an adhesive masking tape (water soluble) by photo-resist technology and then the tape is attached to the working surface of a disk-shaped, stainless steel tool pre-form that has been coated with an adhesive (water insoluble) such that the water-insoluble adhesive is exposed by the holes of the mask. Diamond abrasive grains (FEPA D251; 60/70 US mesh grit size; average diameter of 250 microns; diamond obtained from GE Corporation, Worthington, Ohio) are positioned in the holes of the masking tape and adhered by means of the exposed water insoluble adhesive coating on the pre-form. The masking tape then is washed off the pre-form.

The core is mounted onto a stainless steel shaft and electrically contacted. After cathodic degreasing, the assembly is immersed in an electrolyte plating bath (a Watt's electrolyte containing nickel sulphate). A metal layer is electrolytically deposited to an average thickness of 10-15% of the attached abrasive grain diameter. The assembly is then removed from the tank and, in a second electroplating step, an overall nickel deposit thickness of 50-60% of the average grain size is applied. The assembly is rinsed, and the plated tool with a single layer of pseudo-random distribution of abrasive grain is removed from the stainless steel shaft.

Method B:

The values of the set of co-ordinates illustrated in FIG. 3 are transferred directly onto a disk-shaped tool pre-form in the form of an array of adhesive micro-drops. The tool pre-form is located on a positioning table equipped with a rotational axis (Microdrop equipment, obtained from Microdrop GmbH, Norderstedt, Germany) that is designed for precisely placing adhesive is droplets (a UV curing, modified acrylate composition) by a micro-dosing system as described in EP1208945 A1. Each adhesive drop is smaller in diameter than the average diameter (250 microns) of the diamond abrasive grain. After placing the center of a diamond grain on each drop of the adhesive and allowing the adhesive to harden and attach the grain array to the pre-form, the tool pre-form is mounted onto a stainless steel shaft and electrically contacted. After cathodic degreasing, the assembly is immersed in an electrolyte plating bath (a Watt's electrolyte containing nickel sulphate) and a metal layer is deposited with an average thickness of 60% of the attached abrasive grain diameter. The tool assembly is then removed from the tank, rinsed, and an electroplated tool with a single layer of abrasive grain positioned in the array shown in FIG. 3 is removed from the stainless steel shaft.

We claim:

1. A method for manufacturing abrasive tools having individual abrasive grains placed in a controlled, random spatial array such that the individual grains are non-contiguous, comprising the steps of:

(a) selecting a two-dimensional planar area having a defined size and shape;

(b) selecting a desired abrasive grain grit size and concentration for the planar area;

(c) selecting a series of coordinate value pairs $(x_1, y_1)$ such that the coordinate values along at least one axis are restricted to a numerical sequence wherein each value differs from the next value by a constant amount;

(d) decoupling each selected coordinate value pair $(x_1, y_1)$ to yield a set of selected x values and a set of selected y values;

(e) randomly selecting from the sets of x and y values a series of random coordinate value pairs (x, y), each pair having coordinate values differing from coordinate values of any neighboring coordinate value pair by a minimum value (k);

(f) generating an array of the randomly selected coordinate value pairs having sufficient pairs, plotted as points on a graph, to yield the desired abrasive grain concentration for the selected two dimensional planar area and the selected abrasive grain grit size; and (g) centering an abrasive grain at each point on the array.

2. The method of claim 1, further comprising the step of bonding the array of abrasive grains with an abrasive bonding material to secure an abrasive grain at each point of the array.

3. The method of claim 1, further comprising the step of bonding the array of abrasive grains to a substrate to form an abrasive tool.

4. The method of claim 3, wherein the substrate is selected from the group consisting of a rigid tool pre-form and a flexible backing and combinations thereof.

5. The method of claim 4, wherein the rigid tool pre-form has a geometric shape having one axis of rotational symmetry.

6. The method of claim 5, wherein the geometric shape of the rigid tool pre-form is selected from the group consisting of disk, rim, ring, cylinder and frustoconical shapes, and combinations thereof.

7. The method of claim 4, wherein the flexible backing is selected from the group consisting of films, foils, fabrics, non-woven sheets, webs, screens, perforated sheets, laminates and combinations thereof.

8. The method of claim 4, wherein the flexible backing is converted into a form selected from the group consisting of belts, discs, sheets, pads, rolls and ribbons.

9. The method of claim 1, further comprising the steps of a) after step (f), imprinting the array of the restricted, randomly generated coordinate values, plotted as points on a graph, onto a tool substrate; and b) after step (g), securing an abrasive grain at each point of the array on the tool substrate with an abrasive bonding material.

10. The method of claim 1, further comprising the steps of a) after step (f), imprinting the array of the restricted, randomly generated coordinate values, plotted as points on a graph, onto a template;

b) after step (g), securing an abrasive grain at each point of the array on the template to form an abrasive grain array;

c) transferring the template bearing the abrasive grain array onto a tool substrate; and d) adhering the abrasive grain array to the tool substrate with an abrasive bonding material.

11. The method of claim 10, further comprising the step of removing the template from the tool substrate.

12. The method of claim 10, further comprising the step of bonding the template bearing the array of abrasive grains onto the tool substrate to form the abrasive tool.

13. The method of claim 2, wherein the abrasive bonding material is selected from the group consisting of adhesive materials, brazing materials, electroplating materials, electromagnetic materials, electrostatic materials, vitrified materials, metal powder bond materials, polymeric materials and resin materials, and combinations thereof.

14. The method of claim 1, wherein the array is defined by a set of Cartesian coordinates (x, y).

15. The method of claim 1, wherein the array is defined by a set of polar coordinates (r, θ).

16. The method of claim 15, wherein the array is defined further by a set of Cartesian coordinates (x, y).

17. The method of claim 1, wherein the minimum value (k) exceeds the maximum diameter of the abrasive grain.

18. The method of claim 17, wherein the minimum value (k) is at least 1.5 times the maximum diameter of the abrasive grain.

19. The method of claim 2 further comprising the step of converting the bonded abrasive grain array from a two-dimensional structure to a three-dimensional structure by rolling the bonded abrasive grain array into a concentric roll.

20. The method of claim 1, wherein the abrasive grain is selected from the group consisting of single abrasive grits, cutting points and composites comprising a plurality of abrasive grits, and combinations thereof.

* * * * *